US006291933B1

(12) United States Patent
Dombrowski et al.

(10) Patent No.: US 6,291,933 B1
(45) Date of Patent: Sep. 18, 2001

(54) METAL HALIDE LAMP WITH ARC TUBE SECURED TO FRAME BY CLIPS PASSING THROUGH PROTECTIVE SLEEVE

(75) Inventors: Kevin S. Dombrowski, Painted Post, NY (US); Kevin D. Provagna, Medina, OH (US); Richard Intihar, Jr., Concord, OH (US); James M. Gensert, Litchfield, OH (US)

(73) Assignees: Philips Electronics North America Corporation, New York, NY (US); Supro Spring and Wireforms, Inc., Medina, OH (US)

( * ) Notice: Subject to any disclaimer, the term of this patent is extended or adjusted under 35 U.S.C. 154(b) by 0 days.

(21) Appl. No.: 09/406,288

(22) Filed: Sep. 24, 1999

(51) Int. Cl.[7] ..... H01J 1/02; H01J 61/52; H01J 7/24; H01J 1/00; H01J 19/00

(52) U.S. Cl. ..... 313/25; 313/26; 313/238; 313/631; 313/229; 313/623; 313/634; 313/17

(58) Field of Search ..... 313/25, 26, 238, 313/631, 229, 17, 252, 573, 634, 623; 445/26, 22

(56) References Cited

U.S. PATENT DOCUMENTS

| | | | | |
|---|---|---|---|---|
| 4,281,274 | | 7/1981 | Bechard et al. | 315/49 |
| 4,580,989 | * | 4/1986 | Fohl et al. | 445/26 |
| 5,079,480 | | 1/1992 | Canale et al. | 315/47 |
| 5,136,204 | * | 8/1992 | Muzeroll et al. | 313/25 |
| 5,532,543 | * | 7/1996 | Van Der Leeuw et al. | 313/25 |
| 5,729,078 | | 3/1998 | Pragt | 313/25 |

* cited by examiner

*Primary Examiner*—Nimeshkumar D. Patel
*Assistant Examiner*—Sikha Roy
(74) *Attorney, Agent, or Firm*—Dicran Halajian

(57) ABSTRACT

Metal halide lamp includes an arc tube and a surrounding tubular quartz sleeve between a pair of parallel wire frame members mounted to a glass stem containing current supply leads. The sleeve is provided with two pairs of diametrically opposed apertures, each pair of apertures receiving an elongate wire U-clip which engages a pinched end of the arc tube inside the sleeve and the frame members outside the sleeve. Distal ends of each U-clip are welded to a frame member to fix the position of the arc tube and the sleeve.

8 Claims, 3 Drawing Sheets

METAL HALIDE LAMP WITH ARC TUBE SECURED TO FRAME BY CLIPS PASSING THROUGH PROTECTIVE SLEEVE

BACKGROUND OF THE INVENTION

The invention relates to a lamp, in particular metal halide discharge lamp having a protective sleeve surrounding an arc tube, wherein the sleeve and the arc tube are supported by a metal frame mounted to the stem, and a glass envelope fixed to the stem surrounds the sleeve.

Metal halide lamps typically incorporate a tubular shield surrounding the pressurized arc tube to absorb the impact of dispersing shards in the event the arc tube fractures. Both the shield and the arc tube are supported by a metal frame mounted to the stem, which frame is electrically isolated from the leads for the arc tube. This is especially important for high wattage lamps. Since current carrying members in proximity to the arc tube can cause sodium loss, it is preferable to electrically distance the current carriers from the lateral walls of the arc tube.

U.S. Pat. No. 6,153,968 discloses a metal halide lamp of the type described above, wherein an arc tube and the surrounding shield are supported by a metal frame mounted to the stem. The shield is a quartz sleeve whose ends are fitted with retaining rings which are welded to respective frame members on either side of the sleeve. The arc tube has pinched ends which extend beyond the sleeve. Each pinched end is fitted with a metal strap which is welded to the frame members. Current is supplied to the arc tube by a braided wire for the lower electrode and a flying lead well spaced from the arc tube for the upper electrode. The construction is especially suitable for a 1000 watt lamp.

The arrangement of the prior art requires two rings for mounting the sleeve and two straps for mounting the arc tube, which is four metal components requiring at least four welds for fixing to the frame members. Since the pinched ends of the arc tube extend beyond the protective sleeve, it is possible that shards of arc tube will impinge the outer envelope if the lamp fails.

U.S. Pat. No. 5,729,078 also discloses a discharge lamp wherein an arc tube and the surrounding shield are supported by a metal frame mounted to the stem. The frame is directly connected to leads in the stem. For high wattage lamps, which have larger components, this would place undue stress on the stem. Since the frame is not electrically isolated, sodium loss would be unacceptable in high wattage lamps. Further, the pinched ends of the arc tube still extend beyond the shield.

In order to reduce manufacturing costs in a lamp having an electrically floating frame, it would be preferable to reduce the number of parts and the number of welding steps. From a safety standpoint, it would also be preferable for the protective sleeve to extend beyond the ends of the arc tube.

SUMMARY OF THE INVENTION

According to the invention, the tubular sleeve is provided with a pair of diametrically opposed apertures adjacent to each end, each pair of apertures lying in the plane defined by a respective one of the pinched ends. An elongate U-clip formed of steel wire is received through each pair of apertures; each U-clip engages a pinched end of the arc tube inside the sleeve and the frame members outside the sleeve. The distal ends of each U-clip are welded to the respective frame member, thereby fixing the position of both the arc tube and the sleeve to the frame.

The only mounting hardware required for both the arc tube and the sleeve is two identical U-clips which are formed from steel wire. Since each clip may be fixed to the frame with a single weld, only two welding operations are required. Manufacturing costs are thus considerably reduced, as compared to the prior art.

Since the apertures for receiving the U-clips are spaced from the ends of the sleeve, the sleeve may extend beyond the pinched ends of the arc tube. In the event that the arc tube fails, this helps to assure that flying fragments will not hit the outer envelope and cause it to fracture.

These and further advantages will be apparent from the drawing and description which follow.

DETAILED DESCRIPTION OF THE PREFERRED EMBODIMENT

Figure 1A:
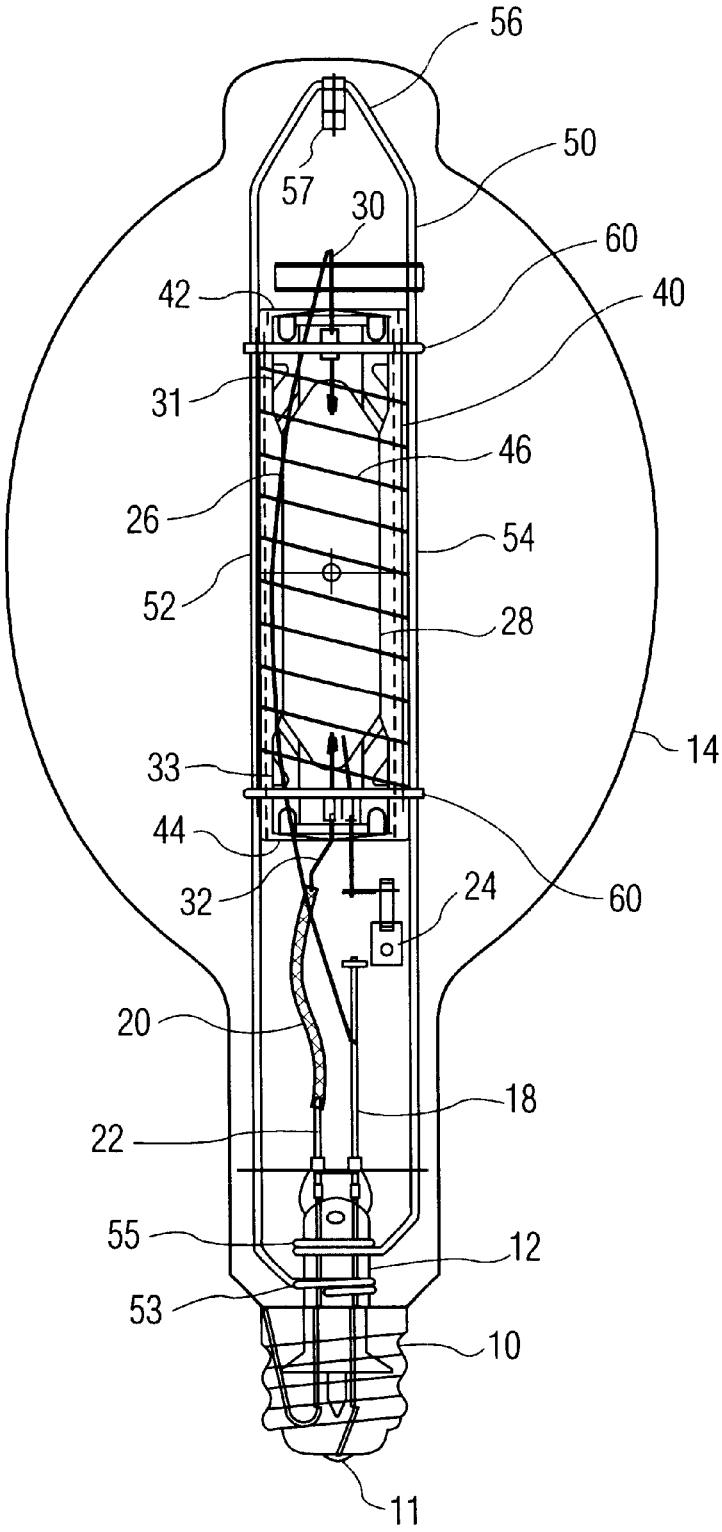
FIG. 1*a* is a side view of the lamp according to the invention.
Figure 1B:
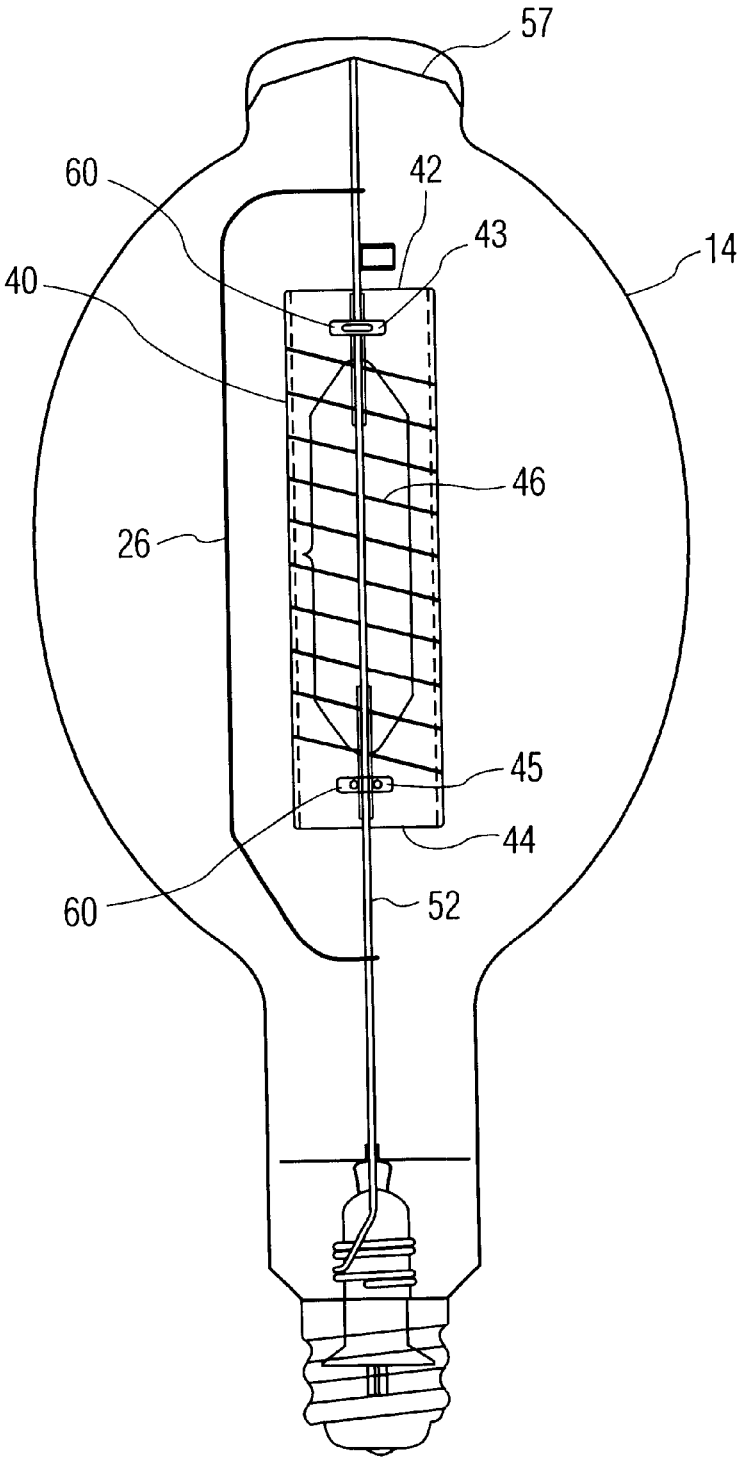
FIG. 1*b* is a side view seen orthogonally to FIG. 1*a;*

FIGS. 1*a* and 1*b* show a metal halide discharge lamp including: a screw base 10 with an insulated center contact 11, a glass stem 12, and a glass envelope 14 sealed to the stem. Inside the lamp is an arc tube 28 with opposed pinched ends 31, 33. A first lead 18 and a second lead 22 are received through the stem 12 and connected to respective lead-throughs 30, 32 in opposed pinched ends 31, 33 of the arc tube. These serve as electrodes for maintaining an arc. The first lead 18 is connected to the first lead-through 30 via flying lead 26, while the second lead 22 is connected to the second lead-through 32 via braided connection 20. Before the lead 26 carries current, a starter 24 causes a glow discharge at the first end, whereupon a bimetal strip in the starter 24 opens to shunt current through lead 26 to the second electrode. Starting circuits are described in some detail in U.S. Pat. No. 5,079,480.

The frame 50 is formed of steel wire and includes a pair of parallel frame members 52, 54 connected by an intermediate section 56. Each of the members 52, 54 is formed at its lower and with a respective coil 53, 55 which is fitted around the stem 12 as described in U.S. Pat. No. 6,153,968. The top 56 has welded thereto a leaf spring 57 which positions the frame with respect to the envelope 14.

A tubular sleeve 40 made of quartz surrounds the arc tube 28 between the upright frame members 52, 54. The quartz sleeve 40 absorbs the impact of flying shards of arc tube in the event of non-passive failure. A wire helix 46 surrounding the sleeve 40 limits radial dispersion of any quartz fragments in the event the sleeve 40 fractures, thus further protecting the glass envelope 14 in the event of arc tube failure. The sleeve 40 has a pair of diametrically opposed apertures 43 adjacent to its upper end 42, and a pair of diametrically opposed apertures 45 adjacent to its lower end 44. Each pair of apertures 43, 45 receives an elongate U-clip 60 which engages one of pinched ends 31, 33 inside the sleeve 40 and the frame members 52, 54 outside the sleeve. The apertures 43, 45 are elongate slots which are cut transversely to the axis of the tubular sleeve 40 with a diamond wheel. Each pair of apertures 43, 45 lies in the plane of a respective one of the pinched ends 31,33.

Figure 2:
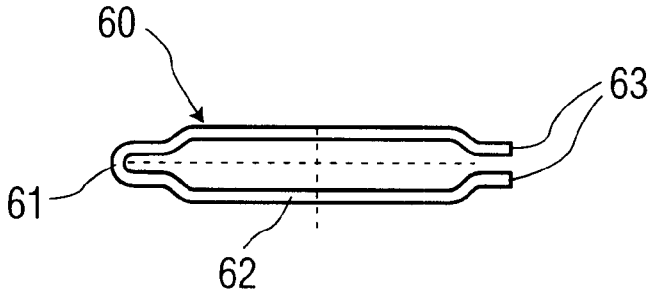
FIG. 2 is a plan view of the U-clip.

Referring to FIG. 2, the clip 60 comprises a bight 61, a central section 62, and a pair of distal ends 63. The central section 62 is wider than the bight 61 and the spacing between distal ends 63, and is sized to accommodate one of the pinched ends 31, 33 in a snug fit. The clip 60 is formed of 0.050" 316 stainless steel wire.

Figure 3:
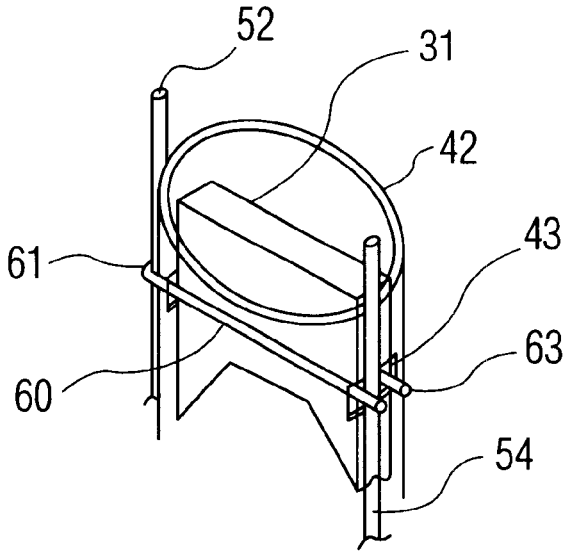
FIG. 3 is a perspective of an end of the arc tube and sleeve.

Referring to FIG. 3, the bight 61 engages frame member 52, while the distal ends 63 engage the frame member 54. The upper end 42 of the sleeve 40 extends beyond the pinched end 31 of the arc tube, while the lower end 44 extends beyond the pinched end 33. This provides better containment of arc tube fragments than designs where the pinches extend beyond the shield, and is possible because the clips 60 engage the pinches 31, 33 inside the sleeve 40. In order to assure that the central section 62 remains firmly engaged to the pinch 31, the distal ends 63 are welded to frame member 52. The lower clip 60 is received through the sleeve 40 in the opposite direction, so that its distal ends are welded to frame member 54. The welding also provides axial stability of the arc tube 28 and sleeve 40 with respect to frame 50.

To assemble the lamp, the frame 50 is mounted by fitting the coils 53, 54 around the stem 12, whereupon the are tube 28 and sleeve 40 are mounted with clips 60. The braided connection 20 and flying lead 26 are then connected between the leads 18, 22 and the an tube leads 30, 32. Finally, the glass envelope 14 is sealed to the stem 12 and base 10 is fitted.

The foregoing is exemplary and not intended to limit the scope of the claims which follow.

What is claimed is:

1. A lamp comprising a light source having a pair of opposed pinched ends, each said pinched end defining a plane, a pair of substantially parallel wire frame members, a tubular sleeve surrounding said light source between said frame members, said sleeve comprising at least one pair of diametrically opposed apertures lying in the plane of a respective at least one of said pinched ends, and an elongate U-clip received through each said pair of apertures, each said U-clip engaging one of said pinched ends inside of said sleeve and engaging said frame members outside of said sleeve.

2. A lamp as in claim 1 wherein said apertures are slots cut transversely to the axis of the tubular sleeve.

3. A lamp as in claim 1 wherein said sleeve extends beyond said pinched ends of said light source.

4. A lamp as in claim 1 wherein said lamp further comprises a glass stem and a pair of leads embedded in said glass stem for supplying electrical current to said light source, said frame members being electrically isolated from said leads.

5. A lamp as in claim 4, wherein said frame members are formed from a single wire having opposite ends fixed to said glass stem.

6. A lamp as in claim 5 wherein said ends of said frame members are formed with coils which are fitted around said stem.

7. A lamp as in claim 1 wherein said U-clip is formed from wire.

8. A lamp as in claim 1 wherein said light source is a metal halide arc tube.

* * * * *